US007612308B2

(12) United States Patent
Arnau Manresa

(10) Patent No.: US 7,612,308 B2
(45) Date of Patent: Nov. 3, 2009

(54) CONTROLLER FOR ELECTRICAL TOY VEHICLE

(75) Inventor: Luis Maria Arnau Manresa, Barcelona (ES)

(73) Assignee: Winkler International, SA, Luxembourg (LU)

( * ) Notice: Subject to any disclaimer, the term of this patent is extended or adjusted under 35 U.S.C. 154(b) by 136 days.

(21) Appl. No.: 11/962,272

(22) Filed: Dec. 21, 2007

(65) Prior Publication Data

US 2009/0163112 A1 Jun. 25, 2009

(51) Int. Cl.
*H01H 9/06* (2006.01)

(52) U.S. Cl. ..... 200/332.2; 200/332.1

(58) Field of Classification Search ..... 200/345–314, 200/332.2

See application file for complete search history.

(56) References Cited

U.S. PATENT DOCUMENTS 6,616,501 B2 * 9/2003 Spalinski ..... 446/279
6,692,333 B2 * 2/2004 Kislevitz et al. ..... 446/437
7,217,170 B2 * 5/2007 Moll et al. ..... 446/164
7,234,990 B2 * 6/2007 Leonov et al. ..... 446/440
7,261,615 B2 * 8/2007 Hoeting et al. ..... 446/456

* cited by examiner

*Primary Examiner*—Michael A Friedhofer
*Assistant Examiner*—Lisa N Klaus
(74) *Attorney, Agent, or Firm*—Nixon & Vanderhye, PC

(57) ABSTRACT

A toy vehicle controller include a casing with a grip (1) topped by a widened zone (2). A resistance element (3) is mounted in the widened zone (2), and it provides a variable resistance depending on a position of a cursor (4) that moves under the action of a trigger (5). A first arm (16) and a second arm (17) of the cursor touch opposite sides of the resistance element (3). A first wire (6) is connected to a first terminal (10), and the resistance element (3) is coupled to the first terminal (10). A second wire (7) is connected to a second terminal (11), and the second terminal (11) is couple to the cursor (4). As the trigger is depressed, the first and second arms of the cursor move along the resistance element to vary a resistance in the circuit formed between the first and second wires. When a user depresses a button (15), the head (20) of an elastic element (13) is pushed into contact with the first terminal (10). If the first arm (16) of the cursor (4) is in electrical contact with the elastic element (13), this effectively short circuits the first and second wires, removing the resistance element (3) from the circuit, and delivering all available voltage to the toy vehicle.

7 Claims, 2 Drawing Sheets

CONTROLLER FOR ELECTRICAL TOY VEHICLE

BACKGROUND

1. Field

The invention relates to controllers which are used to control the speed of electrical to vehicles.

2. Background

It is known to use hand-held controllers for controlling the speed of electrical toy vehicles. Such controllers typically have a trigger which increases or decreases the speed of such toy vehicles depending on how far the trigger is depressed.

U.S. Pat. No. 3,705,387 entitled "Remote control system for electro-mechanical vehicle," dated 1971, in the name of Mr. Kenneth Stern et al., discloses a remote electronically controlled vehicle which is movable between two conductive tracks. The vehicle is equipped with electrical control devices for steering and driving of the vehicle. The toy vehicle is connected to conducting contacts on the track surfaces. The conducting track is equipped to handle a plurality of these vehicles through a single electronic control unit having a multiple channel FM telemetry circuit including an oscillator and mixer circuit. Multiple individual manual controls corresponding to the number of vehicles on the conductive tracks can be attached to the control unit for individual independent control of the vehicles on the conductive tracks.

Spanish Utility Model No. 9801722 (ES1040729), dated 1998, discloses a controller for toy cars. The controller includes a housing that forms a hand grip, topped by a wider area that houses a variable resistance element. The resistance varies depending on the position of a cursor, which is moved by the action of a trigger mounted on the casing. The resistance element and the cursor are connected to a corresponding power terminal. The resistance element is mounted on a block, which provides a shelter, and it is fixed by screws.

U.S. Pat. No. 4,112,615, entitled "Remote control system for a movable toy vehicle," discloses a wireless transceiver control system for motor driven toy vehicle. The device has a transmitter for generating a predetermined carrier of selected high frequency, and a receiving unit including a super-regenerative detection circuit for receiving the high frequency carrier. A relay switch, for reversing the power to the electrical motor driving the toy vehicle, can be energized by the amplified noise signal to retain the switch in one position and release a relay to a second position. A gear train drives the vehicle in one direction when the switch is in one position, and it drives the vehicle in the same direction and also turns the wheels of the vehicle when the switch is in the second position.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings, in which like reference numerals refer to like elements, and wherein.

DETAILED DESCRIPTION

Figure 1:
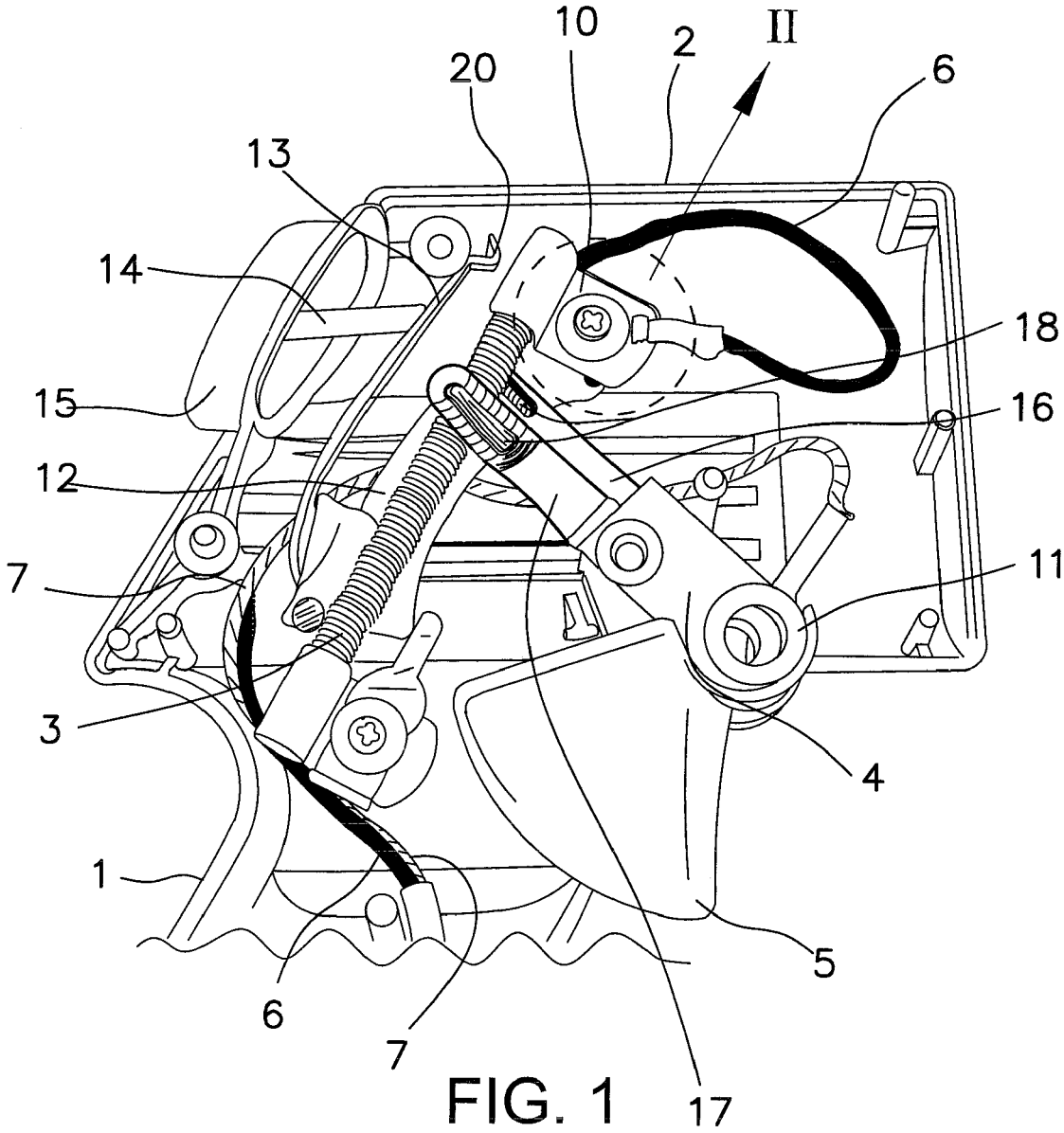
FIG. 1 is a diagram showing the elements mounted in a top portion of a first embodiment of a toy vehicle controller.

FIG. 1 illustrates the top portion of a controller for a toy vehicle. The controller includes a grip 1, a zone widened 2, and a resistance element 3. A cursor 4 includes a first arm 16 and a second arm 17. The cursor is coupled to a trigger 5 which can be depressed by the user. The controller further include a first cable 6, a second cable 7, a first terminal 10, a second terminal 11, a badge 12, an elastic extension 13 and head 20, a push-button 15 with its projection 14 and a protuberance 18.

The resistance element 3 has one end connected to the first cable 6 and the first terminal 10. The cursor 4, which is coupled to the trigger 5, is connected to the second cable 7 through the second terminal 11. The arms 17,18 of the cursor 4 are positioned on either side of the resistance 3. Depressing the trigger 5 causes the arms 17,18 to move along the resistance element toward the first terminal 10, thereby reducing the value of electrical resistance between the first cable 6 and the second cable 7. Thus, in turn, increasing the voltage delivered to the toy vehicle being controlled by the controller. Increasing the voltage delivered to the electric vehicle toy increases its speed on the track.

Figure 2:
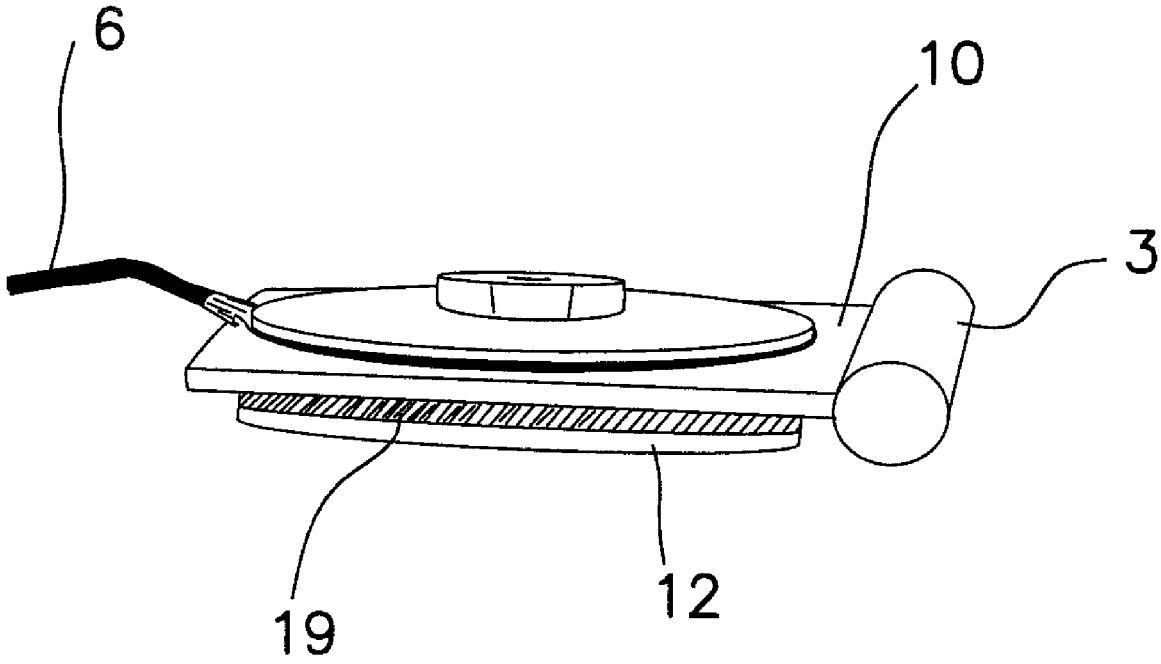
FIG. 2 is a perspective view showing the elements circled by line II in FIG. 1.

The first arm 16 of the cursor 4 is provided between the badge 12 and the resistance element 3. In this embodiment, the badge 12 is inclined relative to the resistance element 3. An insulating element 19 is positioned between the badge 12 and the terminal 10, as shown in FIG. 2, which prevents contact between the two.

As the trigger 5 is depressed, the cursor 4 moves toward the terminal 10. Because the badge 12 is inclined relative to the resistance element 3, at some point during the cursor's travel, the back side of the first arm 16 comes in contact with the badge 12. This has no immediate effect, as the electricity must still pass from the first terminal 10, down the resistance element 3, into the first and second arms 16, 17 and then to the second terminal 11.

However, once the cursor has moved to a position where the first arm 16 is in contact with the badge 12, the user can push a "turbo" button 15 to suddenly increase the voltage delivered to the toy vehicle. The button 15 has a projection 14 that contacts the elastic extension 13 of the badge 12. The elastic extension 13 ends in a head 20, which confronts with the first terminal 10. When a user pushes the button, the projection 14, in turn, pushes the elastic extension 13 such that the head 20 comes into contact with the first terminal 10. This eliminates the resistance element 3 from the circuit so that all of the available voltage can be delivered to the toy vehicle, providing maximum speed. When the user releases the button 13, the head 20 no longer makes contact with the terminal 10, and the resistance element 3 is introduced back into the circuit.

To facilitate contact between the badge 12 and the resistance element 3, the first and second arms 16, 17 of the cursor 4 may include bumps 18 on their ends.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although an embodiment has been described, it should be understood that numerous other modifications and embodiments can be devised by those skilled in the art that will fall within the spirit and scope of the principles of this disclosure.

More particularly, various modifications are possible in the component parts and/or arrangements which would fall within the scope of the disclosure, the drawings and the appended claims. In addition to variations and modifications in the component parts and/or arrangements, alternative uses will also be apparent to those skilled in the art.

What is claimed is:

1. A controller for electric toy vehicles, comprising:

a casing with a grip;

a resistance element mounted in the casing and coupled to a first terminal;

a trigger mounted on the casing such that a user can selectively depress the trigger;

a cursor coupled to the trigger, wherein the cursor is coupled to a second terminal and includes at least one arm that contacts the resistance element, and wherein when the user depresses the trigger, the cursor moves the at least one arm along the resistance element to vary a resistance of a circuit formed between the first and second terminals;

a badge mounted on the casing such that the at least one arm of the cursor is brought into contact with the badge an elastic extension coupled to the badge, wherein an end of the elastic extension confronts the first terminal; and a button that is movable mounted on the casing, wherein when the button is depressed, the button causes the end of the elastic extension to contact the first terminal, thereby removing the resistance element from the circuit formed between the first and second terminals.

2. The controller of claim 1, wherein the badge is inclined relative to the resistance element.

3. The controller of claim 2, wherein the inclination of the badge relative to the resistance element is such that the at least one arm of the cursor will only be brought into contact with badge after the trigger has been depressed by a predetermined amount.

4. The controller of claim 1, wherein a protuberance is formed on an end of the at least one arm of the cursor.

5. The controller of claim 1, wherein the end of the elastic element includes a head which confronts the first terminal.

6. The controller of claim 1, wherein the elastic element provides a biasing force that tends to push the end of the elastic element away from the first terminal.

7. The controller of claim 1, wherein the at least one arm of the cursor comprises first and second arms which are positioned on opposite sides of the resistance element.

* * * * *